United States Patent [19]

Doyle et al.

[11] 4,053,198

[45] Oct. 11, 1977

[54] ELECTRICAL CONNECTOR MEANS

[75] Inventors: Richard C. Doyle, Greenlawn; James E. Meehan, Levittown, both of N.Y.

[73] Assignee: Slater Electric Inc., Glen Cove, N.Y.

[21] Appl. No.: 679,785

[22] Filed: Apr. 23, 1976

[51] Int. Cl.[2] ..... H01R 13/58

[52] U.S. Cl. ..... 339/103 R; 339/75 P; 339/107

[58] Field of Search ..... 339/103 R, 103 M, 272 UC, 339/107, 75 P, 76, 77, 79, 91 R

[56] References Cited

U.S. PATENT DOCUMENTS 3,818,420 6/1974 Barr ..... 339/103 R X

*Primary Examiner*—Roy Lake
*Assistant Examiner*—DeWalden W. Jones
*Attorney, Agent, or Firm*—Morgan, Finnegan, Pine, Foley & Lee

[57] ABSTRACT

An electrical connector assembly for installation on a cable including a connector housing, a connector body lockably receivable in the housing, an adjustable grasping assembly for securely engaging the cable, and a collar threadably engagable on the housing for adjusting the grip on the cable. Advantageously, at least two clip members are mounted to the body and are formed with fastening portions adapted to engage receiving members in the housing for assembly of the body and housing without requiring threaded fasteners. Also advantageously, the housing is provided with a detent member adapted to project against the threads of the collar which is provided with abutment means to be abutted by the detent when reverse threading of the collar is attempted, but permit threading of the collar onto the housing in ratchet-like manner. Furthermore, the body may be formed with recesses extending radially inwardly thereof for retaining electrical contacts within the projected area of the body, and with apertures in the back of the body, providing access to the contact for an electrical conductor.

32 Claims, 10 Drawing Figures

ELECTRICAL CONNECTOR MEANS

BACKGROUND AND OBJECTS OF THE INVENTION

The present invention relates generally to connector means and, more particularly, to electrical connector means known commercially as "electrical caps and connectors". Thus, although the invention will be described primarily with reference to plug connector means (the cable "cap" ), it is equally applicable to corresponding receptacle connector means (the cable "connector").

The art is replete with connector devices for coupling a pair of electrical cables. Many of these devices include some type of bracket means for grasping the cables after they have been attached to the electrical contacts on the connector bodies in order to relieve the strain thereon. Attempts have been made at simplifying these bracket structures and include such devices as universal chucks. However, such chuck devices suffer a significant drawback in that connectors incorporating them have been subject to unwinding, leaving the cable susceptable to strain, and even pulling out.

In addition, heretofore, the connector body, which has been coupled to the cable, has usually been attached to or installed in a connector housing by metallic screws. These structures suffer several disadvantages. Numerous small fastening screws are used to complete installation, requiring small tools, inconveniencing the electrician and adding to fabrication costs. Furthermore, and of substantial significance here, the metallic fasteners are usually installed on the surfaces of connector bodies which are to face each other when plugged together. The proximity of these metallic parts always gives rise to the potential danger of a short circuit.

Furthermore, cap and connector apparatus heretofore known have generally necessitated fabrication in more than one size in order that most three-conductor cables may be fitted with these devices. Thus, significant additional fabrication expenses and efforts are required.

Accordingly, there is a need for a new and improved electrical cap and connector assembly capable of relatively simple and inexpensive fabrication; enabling speedy, secure and simple installation; and characterized by safe and durable construction.

It is therefore an object of the present invention to provide new and improved electrical connector apparatus. Another object of the invention is to provide a new and improved electrical connector apparatus capable of substantially speedy and simple installation.

It is also an object of the invention to provide a new and improved electrical connector apparatus which enables lockable installation of an electrical cable to substantially prevent inadvertent disassembly.

It is a further object of the invention to provide a new and improved electrical connector apparatus characterized by dead surfaces having no exposed metallic parts with the exception of the protruding plug prongs.

It is an additional object of the invention to provide a new and improved electrical connection apparatus which can be assembled by simply snaping the connector body into the connector housing.

It is yet another object of the invention to provide a new and improved electrical connector apparatus which minimizes the number of threaded fasteners required for complete assembly.

It is a further object of the present invention to provide a new and improved electrical connector apparatus most of whose component parts, can be fabricated from a moldable plastic material.

It is still another object of the invention to provide new and improved connector apparatus wherein one size fits essentially all three-conductor cables for a wide range of amperage rating.

Objects and advantages of the invention are set forth in part herein and in part will be apparent herefrom, or may be learned by practice with the invention, the same being realized and attained by means of the structures, instrumentalities and combinations pointed out in the appended claims. Accordingly, the invention resides in the novel parts, structures, arrangements, combinations and improvements herein shown and described.

SUMMARY OF THE INVENTION

Briefly described, the improved connector apparatus according to the present invention include a generally cylindrical connector body formed with a suitable electrical outlet (plug or receptacle) and adapted to be coupled to an electrical cable; a generally cylindrical and hollow connector housing adapted to receive the connector body; and, at least two flexible but substantially resilient clip members attached to generally diametrically opposed sides of the connector body. The clip members are formed with fastening means adapted for lockable engagement with suitable receiving means formed in the connector housing. Advantageously, and as here preferably embodied, the clip members comprise generally elongate spring metal strips having their free ends rolled back in a generally C-shape to form generally rounded fastening beads, and, the housing is formed with structural lips or ridges adapted to lockably receive the fastening beads by allowing the rounded portion of the beads to slide over the lips in a ratchet-like manner when the body is inserted into the housing but bear against the flat portion of the beads to prevent removal therefrom.

According to another aspect of the present invention, the connector body is formed with recesses extending radially inwardly of its outer wall and dimensioned to support electrical contact means within the area projected by the outer wall of the body. To this end, the back of the body is also formed with apertures opening into these recesses to permit insertion of the conductor wires thereinto and coupling to the contact means.

According to still another aspect of the invention, the connector housing may be formed with thread means adapted for threadable engagement by a reciprocally threaded collar member with grasping means in the form of triple jaw universal chuck means to grasp the cable, coupled to the connector body, by tightening the collar onto the housing. Advantageously, and as here preferably embodied, detent means are formed on the connector housing and biased to project towards and bear against the threads of the collar, and, the collar is formed with abutment means, preferably in the form of longitudinal discontinuities or slots in the collar threads, oriented perpendicular thereto, against which the detent can bear to prevent unthreading of the collar from the housing while allowing threading of the collar onto the housing in a ratchet-like manner. Also advantageously, the detent may include a button-like protrusion formed thereon for allowing a manually applied force to overcome the biasing on the detent and permit unthreading of the collar.

According to one preferred embodiment the detent, a thin detent flange may be molded to the housing, extending generally tangentially of the housing so as to be resiliently biased against the threads of the collar.

According to another preferred embodiment, the detent may comprise a shaft member rotatably mounted in the housing wall, with a detent edge formed thereon, and biasing means — preferably in the form of a thin flexible and resilient web of material extending from the shaft — abutting a suitable support structure for urging the detent against the threads of the collar.

It will be apparent from the foregoing general description that the objects of the invention specifically enumerated herein are accomplished by the invention as here embodied. Thus, it has been found that connector means made in accordance with the present invention are capable of quicker and easier assembly than caps and connectors heretofore known.

In addition, by constructing connector apparatus with its coupling electrical contacts recessed within the connector body which is attached to the connector housing by the clip members as well as with the universal chuck means, it has been found that connector means can be made in only one size to accommodate substantially all three-conductor cables, for a wide range of amperage rating, as well as some cables having more than three conductors.

It has also been found that by affixing spring clip members to the connector body with fastening means formed on the clip members and receivable in receiving means in the housing, assembly of the connector body and connector housing may readily be accomplished without necessitating threaded fasteners. In addition, by using the clip members as aforesaid, there are no exposed metallic parts on the connector, with the exception of the electrical conducting elements. Thus, completely dead faces are provided at the interface of the plug and receptacle bodies, as well as on all exterior surfaces of the connector, thereby eliminating any possibility of a short circuit, current leakage or electrical shock.

It has been found that by providing detent means in conjunction with the universal chuck, automatic strain relief on the cable may be achieved and permanently retained by the connector.

Furthermore, by constructing cap and connector apparatus according to the invention, the component parts may, with the exception of the electrical conducting and connecting elements, can be made from a moldable plastic material.

It will be understood that the foregoing general description, as well as the following detailed description are exemplary and explanatory of the invention but are not intended to be restrictive thereof. Thus, the accompanying drawings, referred to herein and constituting a part hereof, illustrate preferred embodiments of the invention and, together with the detailed description, serve to explain the principles of the invention.

DETAILED DESCRIPTION OF PREFERRED EMBODIMENTS

Figure 1A:
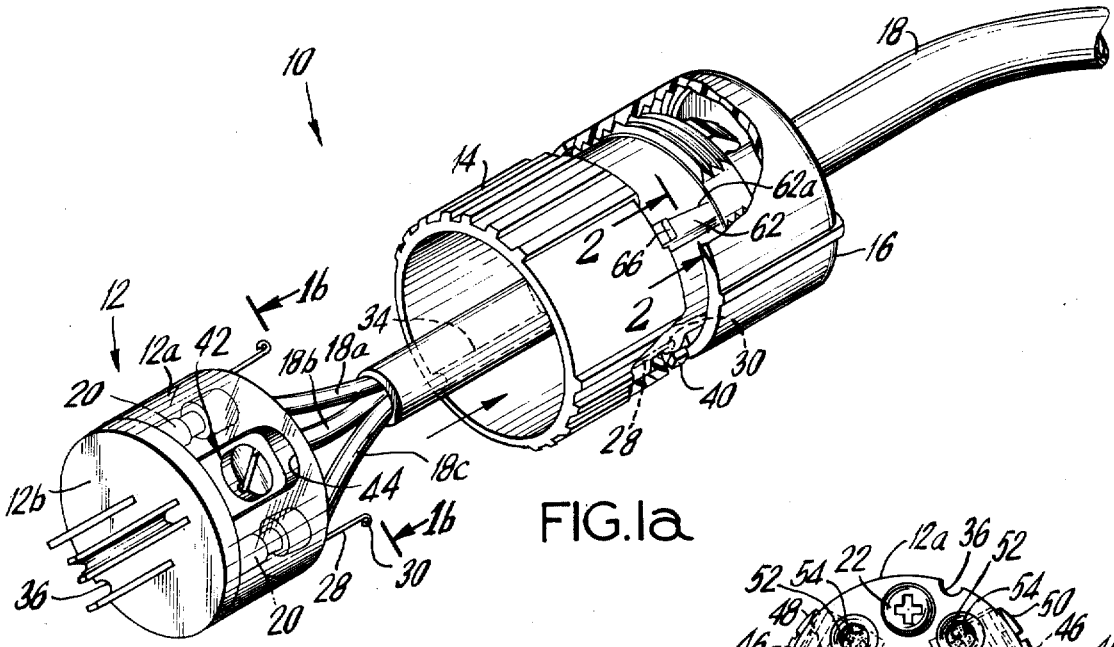
FIG. 1*a* is an exploded, partially cut-away view in perspective of a preferred embodiment of the present invention.
Figure 1B:
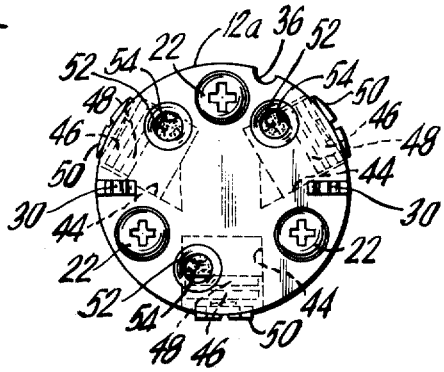
FIG. 1*b* is a view taken along section 1*b*—1*b* of FIG. 1*a*.
Figure 1C:
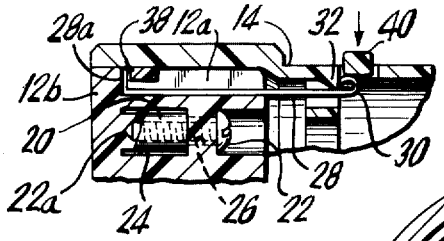
FIG. 1*c* is a cutaway view showing assembly means for the embodiment of FIG. 1*a*.
Figure 2:
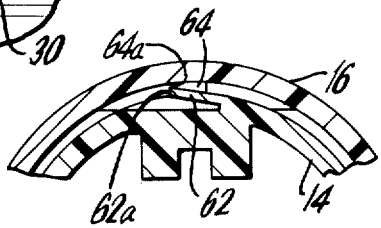
FIG. 2 is a view taken along section 2—2 of FIG. 1*a*.
Figure 3A:
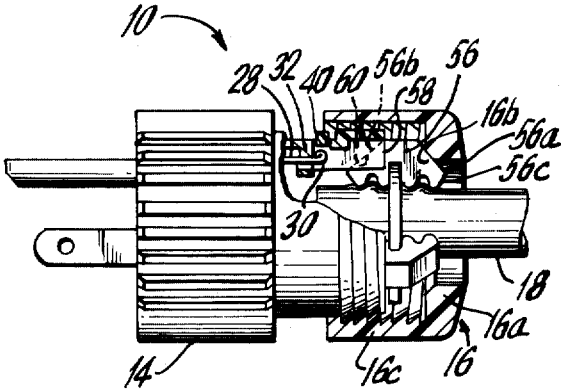
FIG. 3*a* is a side view, partially cut-away, illustrating the assembled apparatus of FIG. 1.
Figure 3B:
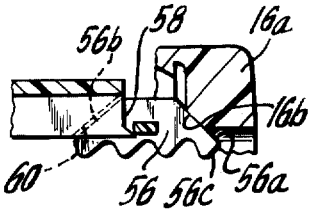
FIG. 3*b* is an enlarged view of the chuck means.

Referring now to the embodiments of the invention illustrated in the accompanying drawings, wherein like reference characters refer to like parts throughout the various views, there is shown in FIGS. 1–3 a preferred embodiment of the invention. Accordingly, connector means (indicated generally by reference numeral 10) of the present invention includes connector body 12, connector housing 14 and collar 16, adapted for installation on the end of insulated electrical conducting cable 18. Although connector body 12 is here illustrated as a three-pronged plug (or male coupling element), it will be understood that the present invention is equally applicable to a receptacle connector body (or female coupling element), as well as any other conventional or desirable coupling member.

Referring now more particularly to FIGS. 1, connector body 12 may comprise connecting member (or rear portion) 12*a*, to which the conductive wires (indicated by reference numbers 18*a*, 18*b* and 18*c*) of cable 18 are connected, and coupling member (or front portion) 12*b*, by which connector means 10 may be coupled to corresponding (here, a receptacle) connector means (not shown). Connecting member 12*a* (illustrated in the drawings as if made from transparent plastic) and coupling member 12*b* may advantageously be made as separate units to enable fabrication from a moldable plastic material by convenient and economical plastic molding techniques and to provide mounting means for a spring clip, as more fully described hereinafter. Thus, after these members have been fitted with the appropriate connecting and coupling structures (plug prongs and electrical contacts), they may be fastened together by any convenient means, such as by threaded fasteners or, where it is desired to limit the number of metallic parts in the connector to only the electrical conducting elements, by a cementing compound.

Referring now to FIG. 1*c*, there is shown a preferred embodiment of fastening means for securing members 12*a* and 12*b*, while enabling easy fabrication of these members and ensuring that there are not exposed metallic fasteners. According to this embodiment, member 12*b* may be molded with at least two, and preferably three, fastening projections 20 adapted to receive threaded fasteners 22 which are inserted through connecting member 12*a*. To this end, connecting member 12*a* may be formed with recesses 24 for accommodating projections 20 and allowing a flush fit between members 12*a* and 12*b*. In addition, unthreaded boreholes 26 are formed in member 12*a* and aligned with projections 20 for accommodating threaded fasteners 22. Advantageously, and as here preferably embodied, threaded fasteners 22 are dimensioned such that, when the combination of members 12*a* and 12*b* has been completely assembled, the end of each fasteners's shank (indicated by reference number 22*a*) will be positioned inwardly of the frontally exposed surface of coupling member 12*b*, such that there are no exteriorly exposed metallic fasteners, as will be described more fully hereinafter.

According to one aspect of the invention, connector body 12 is provided with snap-like quick mounting means for securing body 12 within connector housing 14. Advantageously, these mounting means comprise at least two spring clip members 28 mounted to body 12 and formed with fastening means 30 adapted to lockably engage receiving means 32 formed in housing 14. As preferably embodied, clip members 28 comprise generally elongate, relatively thin, flexible and resilient strips (preferably made of spring steel) attached to and extending rearwardly from body 12, as illustrated in FIGS. 1*a* and 1*c*. In addition, fastening means 30 may be formed by rolling the free end of clip 28 over itself to provide a generally rounded bead-like structure, and receiving means 32 may compromise a lip formed on the inner sidewall of housing 14.

Accordingly, body 12 may be installed in housing 14 by inserting the former into the latter until rounded bead 30 slides over lip 32 in a somewhat ratchet-like manner. Thereafter, bead 30 comes to rest on the side of lip 32 opposite body 12, with the straight edge of bead 30 (generated by the free end/edge of clip 28 after it had been back over itself to form bead 30) abutting lip 32 to prevent bead 30 from sliding back over lip 32 and thereby substantially prevent separation of body 12 and housing 14.

To facilitate proper orientation of body 12 within housing 14, and therefore registration of fastening means 30 and receiving means 32, housing 14 may be advantageously molded with longitudinally extending protrusion 34 and body 14 may be molded with corresponding longitudinally extending slot 36.

In addition, as indicated above, clip 28 may be formed to a generally L-shape at its mounted end, as shown in FIG. 1*c*. Moreover, connecting member 12*a* may be formed with a slight recess 38 to accommodate leg 28*a* of clip 28. Thus, clip 28 may advantageously be secured to body 12, by buttressing leg portion 28*a* against coupling member 12*b* with connecting member 12*a*.

In a particularly useful embodiment of the invention, housing 14 may also be provided with release button 40 to enable disengagement of fastening means 30 and receiving means 32 such that body 12 may be removed from housing 14 when desired, for example, to check on the connections of wires 18*a–c*. Advantageously, release button 40 may comprise a cantilever-like projection molded on housing 14 and extending over aperture 41 formed therein. Thus, button 40 has three of its edges spaced from the edges of aperture 41 in housing 14, but is attached along its fourth edge to housing 14 to provide a resilient cantilever-like button whose rotational travel is parallel to the edge of lip 32, against which bead 30 abuts when assembled. Accordingly, when disassembly is desired, buttons 40 may be pushed inwardly (as indicated by the arrow in FIG. 1*c*) such that bead 30 is moved a sufficient distance to be released from its engagement with lip 32. Thereafter, body 12 may be removed from housing 14.

According to another aspect of the invention, wires 18*a–c* of cable 18 may be easily and conveniently connected to body 12 by contacting means 42 mounted in generally box-like recesses 44 formed in connecting member 12*a*. Advantageously, each contacting means 42 comprises contacting plate 46 which preferably forms part of the coupling means (i.e., a prong of a plug where body 12 is a plug connector or a receptacle contact where body 12 is a receptacle connector), contacting plate 48 and threaded fastener 50. Plate 46 is formed with an unthreaded aperture dimension to permit free insertion of fastener 50, while plate 48 is formed with a threaded aperture adapted to threadably engage fastener 50 such that plates 46 and 48 can be brought together (with one of wires 18*a–c* positioned therebetween) by inserting fastener 50 through the aperture in plate 46, with the head of fastener 50 bearing against plate 46, and threading fastener 50 into the aperture in plate 48. Thus, one of wires 18*a–c* can be securely grasped by and between plates 46 and 48 to make good electrical contact on the wire. Also advantageously, and as here preferably embodied, biasing means 52, preferably in the form of a resilient insulative foam, are positioned within recess 44 to provide a slight bias on plate 48, urging it towards plate 46, to facilitate rethreading of fastener 50 in the event they became disengaged, and, to facilitate installation of wires 18*a–c*, as described more fully hereinafter.

Accordingly, cable 18 may be connected to body 12 by inserting one of wires 18*a–c* through aperture 54, which is formed in member 12*a* and opens into recess 44 to provide access to plates 46 and 48, and between plates 46 and 48. To facilitate installation, especially when biasing foam 52 is provided in recesses 44, plates 46 and 48 may be separated by unthreading fastener 50 a few turns and pushing fasteners 50 inwardly such that plate 48, threadably engaged thereto, is separated from plate 46 and depresses foam 52. After the wire has been inserted between plates 46 and 48, fasteners 50 may be released. Plate 48 is thereby urged toward plate 46 by biasing means 52 to sandwich the wire therebetween such that the wire is temporarily retained in place until the electrician can secure the wire between plates 48 and 48 by turning and tightening thread fastener 50 onto plate 48.

According to another aspect of the invention, lockable engagement means are included on connector 10 to provide strain relief for cable 18, and, particularly, for the connections of wires 18*a–c* to contacts 46/48 in body 12. To this end, collar 16 is threadably engagable onto the other end (i.e., the end opposite that into which body 12 is receivable) of connector housing 14 with a universal three-jaw chuck (indicated by reference number 55) sandwiched between and abutting both collar 16 and housing 14 such that the diameter defined by the interior sides of its jaws may be restricted by threading collar 16 onto housing 14.

Advantageously, and as here preferably embodied, the chuck includes three chuck elements 46 having two sides 56*a* and 56*b* slanted at an acute angle with respect to cable-engaging side 56*c* which is preferably formed with jaw-like projections for securely gripping cable 18. In addition, housing 14 is formed with a receiving slot, defined by sidewalls 58, which serves to retain chuck element 56 properly aligned, in a configuration generally parallel to cable 18. The slot is also provided with end wall 60 oriented at generally the same angle as sidewalls 56*b* on chuck element 56 and adapted for abutting engagement with sidewall 56*b*, to cause chuck element 56 to travel both transversally in the longitudinal direction as well as radially inwardly to restrict the area defined by walls 56*c*, as more fully described hereinafter.

To this end, collar 16 is formed as a hollow cap-like member with a generally reinforced canopy portion 16a formed with a large aperture substantially central of the collar flange 16c. As preferably embodied, canopy 16a is adapted to engage sidewall 56a generally along the perimeter of the aperture formed therein, making a generally line contact therewith, rather than a substantial surface contact as defined between sidewall 56b and end wall 60. Thus, as collar 16 is threaded onto housing 14, chuck elements 56 are urged not only in the lateral direction of threading, but also inwardly as slanted, or ramp-like, sidewalls 56a and 56b are "squeezed" by, respectively, surface 16b on collar 16 and end wall 60 on housing 14. Advantageously, and as here preferably embodied, the threads formed on housing 14 and collar 16 are American Standard buttress threads, which have been found particularly useful since essentially no radial force component is generated such that substantially all of the torque applied between housing 14 and collar 16 is utilized for clamping the cord. Thus, as chuck elements 56 grasp cable 18, due to threading collar 16 onto housing 14, the cable is moved inwardly during the last few turns of collar 18 such that connector 10 automatically relieves the strain on cable 18.

Also as preferably embodied, chuck members 56 are formed with a plurality of grasping jaws on side 56c thereof, in order to spread the clamping force applied to cable 18 over as large an area as possible. In a particularly useful embodiment, chucks 56 may, advantageously, be formed with four grasping jaws.

Referring now to FIG. 2, there is shown a preferred embodiment of the present invention wherein collar 16 may be lockably threaded onto housing 14 such that the automatic strain relief, as aforesaid, is substantially permanently retained by connector 10. Accordingly, housing 14 is provided with detent means biased so as to project against the internal threading on collar 16, and collar 16 is provided with abutment means against which the detent means can wedge or abut to prevent reverse relative rotation of collar 16 and housing 14. Thus, according to one preferred embodiment, detent flange 62 is molded to housing 14 so as to extend generally tangentially of housing 14, such that detent flange 62 will be resiliently biased against the threads of collar 16. In addition, abutment means formed on collar 16 advantageously comprise grooves or slots 64 formed in the threaded portion of collar 16 and extending essentially perpendicular to the threads on collar 16 such that these threads are interrupted. As preferably embodied, there are about six slots 64 formed in collar 16 in a generally symmetrical configuration to provide a plurality of lockable positions for collar 16 on housing 14.

For installation, collar 16 is threaded onto housing 14 with the chuck means engaged therebetween and surrounding cable 18. As collar 16 is rotated, slots 64 and detent flange 62 pass each other in ratchet-like manner such that positive threading (rotation generating threadable coupling of members 14 and 16) is permitted. However, if reverse, or negative, threading is attempted, the detent edge, 62a, of flange 62 becomes wedged into one of grooves 64, due to its being biased against the threads on collar 16, to prevent collar 16 from being threadably disengaged from housing 14. Thus, housing 14 and collar 16 may be automatically lockably engaged to provide substantially permanent strain relief for the coupling between connector 10 and cable 18.

However, there may be instances when it is desired to dis-assemble connector 10, such as, for example, to ascertain the physical condition of wires 18a–c or the status of their connections. To this end, detent flange 62 is formed with protrusion 66 extending generally perpendicular to flange 62. Thus, when disassembly is desired, protrusion 66 may be manually forced generally radially inwardly, not only to overcome the biasing applied to flange 62, but also to withdraw detent edge 62a from its engaging with abutment surface, or wall, 64a of groove 64.

Advantageously, and as here preferably embodied, detent edge 62a is formed at a slight acute angle with respect to the longitudinal axis of housing 14, as shown in FIG. 1a, such that the portion of detent 62 is slightly wider at its end formed with protrusion 66, than at its other end. This structure is particularly useful for enhancing transmission of the releasing force, applied to protrusion 66, along the entire length of detent 62, to ensure complete clearance of detent edge 62a from slot 64. In addition, with protrusion 66 formed at the end of detent 62 farthest from collar 16, a maximum distance, longitudinally along housing 14, is provided to accommodate substantial threading of collar 16 onto housing 14 and thereby accommodate cables 18 of varying diameters.

Figure 4:
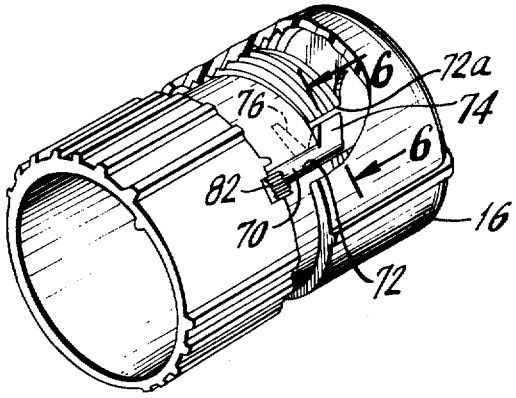
FIG. 4 is a partially cut-away view in perspective of another preferred embodiment of the present invention.
Figure 5:
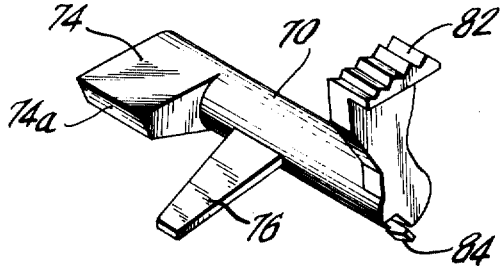
FIG. 5 is a perspective view of a preferred embodiment of detent means according to the present invention.
Figure 6A:
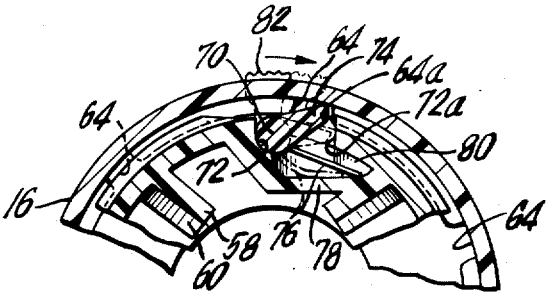
FIGS. 6*a* and 6*b* are a view taken along Section 6—6 of FIG. 4, showing that embodiment with and without, respectively, the detent means of FIG. 5 installed.
Figure 6B:
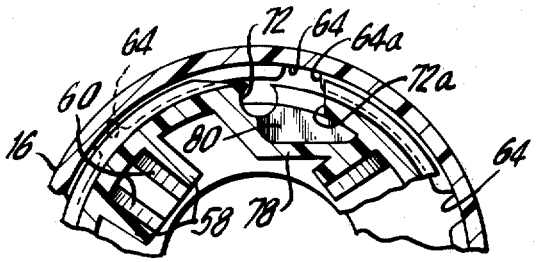

Referring now to FIGS. 4–6, there is shown another preferred embodiment of detent means according to the present invention. As illustrated, detent means includes shaft member 70 rotatably mounted within recess 72 which is formed in housing 14 and is suitably dimensioned to accommodate such rotatable mounting. Detent flange 74 is formed on shaft 70 and adapted to be positioned within the area defined by the threads formed on housing 14. To this end, further recess 72a is formed in housing 14 to provide an aperture-like discontinuity in the threads on housing 14 for accommodating detent 74. In addition, biasing means, preferably in the form of flexible resilient web member 76 formed on shaft 70, is provided to abut a suitable abutment structure in housing 14, advantageously wall 78 formed in housing 14, which provides area 80 to accommodate the biasing action of web 76, as shown in phantom in FIG. 6a. Accordingly, as collar 16 is threaded onto housing 14, detent edge 74a of detent 74 is urged against the threads of collar 16 by biasing means 76, but permits positive threading by passing over grooves 64 in collar 16 in a ratchet-like manner. However, when reverse threading is attempted, detent edge 74a is urged into a groove 64, due to the influence of biasing means 76, and bears against wall 64a of groove 64 to prevent reverse relative rotation of collar 16 and housing 14.

In addition, shaft 70 may also be provided with release button 82 for overcoming the effect of biasing means 76, substantially as described hereinbefore. Accordingly, release button 82 may be urged arcuately, as shown by the arrow in FIG. 6a (which is also the same direction collar 16 is rotated with respect to housing 14 for positive threading thereon), to withdraw detent edge 74a from groove 64 and allow dis-assembly.

In a particularly useful embodiment, shaft 70 may also include barb 84 formed on its end formed with release button 82. Thus, shaft 70 may be conveniently molded from a moldable plastic and inserted within recess 72 (shown in FIG. 6b), with barb 84 ratchetting behind a suitable lip structure to lockably mount shaft 70 rotatably within recess 72.

It will readily be appreciated, however, that the invention in its broader aspects are not limited to the specific embodiment herein shown and described. Rather, variations may be made therefrom within the scope of the accompanying claims, without departing from the principles of the invention and without sacrificing its chief advantages.

What is claimed is:

1. Connector means adapted to be coupled to the end of a cable, which comprises:

a generally cylindrical connector housing member, said housing member being generally hollow and adapted to receive said cable and a connector body, and having thread means formed substantially at one end;

a generally cylindrical collar member, said collar member being generally hollow to receive said cable and having reciprocating thread means for threadably engaging said thread means on said connector housing;

grasping means positioned between said housing and collar members when said members are threadably engaged, said grasping means adapted to securely engage said cable as said collar and housing members are threadably engaged by relative rotation therebetween;

detent means formed on one of said housing and collar members, said detent means adapted to project towards the other of said housing and collar members;

buttressing means formed on said other member, said buttressing means and said detent means proportioned to allow threadable coupling of said housing and collar members by relative rotation of said housing and collar members in one direction, but substantially prevent decoupling by simply reversing said relative rotation.

2. Connector means according to claim 1 wherein said detent means is formed within said thread means of said one member and includes:

a detent member extending generally tangentially of said thread means on said one member, and having a detent edge extending generally parallel to the longitudinal axis of said one member;

biasing means adapted to urge said detent member to bear against said thread means on said other member; and, wherein said buttressing means comprise slot means formed within and extending generally perpendicular to said thread means of said other member and generally parallel to the longitudinal axis of said other member such that, as said collar and housing members are rotatably threaded, said detent flange and said buttressing means permit relative rotation of said collar and housing members in a ratchet-like manner, but substantially prevent unthreading of said collar and housing members by engagement of said detent edge with said slot means when reverse relative rotation of said collar and housing members is attempted.

3. Connector means according to claim 2 wherein said detent means further includes projection means formed thereon, adapted to enable a manually applied force to be applied to said detent means for overcoming the biasing effect of said biasing means to permit said detent edge to be withdrawn from engagement with said slot means, such that said collar and housing members can be rotatably decoupled when desired.

4. Connector means according to claim 3 wherein said slot means include at least six longitudinally extending slots formed in said thread means of said other member in a generally symmetrical arrangement.

5. Connector means according to claim 2 wherein said detent means comprises a substantially thin detent flange member integrally molded to said one member, said detent flange being oriented generally tangentially of said one member such that said detent edge formed on said flange member is adapted to be generally resiliently biased against said thread means of said other member when said collar and housing members are threadably coupled.

6. Connector means according to claim 5 wherein said detent flange member includes projection means formed thereon, adapted to enable a manually applied force to be applied to said detent means for overcoming the biasing effect on said detent flange to permit said detent edge to be withdrawn from engagement with said collar and housing members may be rotatably decoupled when desired.

7. Connector means according to claim 6 wherein said detent edge is formed slightly non-parallel to the longitudinal axis of said one member, such that the portion of said flange member closest to said projection means is slightly wider than the portion of said flange member farthest from said projection means to facilitate transmission of said manually applied force along said flange member and substantially assure clearance of said detent edge from said slot when reverse relative rotation is desired.

8. Connector means according to claim 7 wherein said one member is said connector housing member, having its said thread means formed on its outer wall, and wherein said other member is said collar member, having its said thread means formed on its inner wall.

9. Connector means according to claim 8 wherein said slot means include at least six longitudinally extending slots formed in said thread means of said collar in a generally symmetrical arrangement.

10. Connector means according to claim 2 wherein said detent means comprises a shaft rotatably mounted within the wall of said one member and extending generally parallel to the longitudinal axis of said one member, said shaft being formed with said detent flange and including biasing means coupled between said detent means and said one member to maintain said detent flange biased against said threads of said other member.

11. Connector means according to claim 10 which further includes projection means formed thereon, adapted to enable a manually applied force to be applied to said detent means for overcoming the biasing effect on said detent flange to permit said detent edge to be withdrawn from engagement with said slot means such that said collar and housing members may be rotatably decoupled when desired.

12. Connector means according to claim 11 wherein said biasing means comprise a generally flexible and resilient web formed on said shaft and extending generally perpendicular thereto, said web dimensioned to abut a suitable restraining structure formed on said one member such that said detent edge is resiliently biased against said thread means of said other member.

13. Connector means according to claim 12 wherein said one member is said connector housing member, having its said thread means formed on its outer wall, and wherein said other member is said collar member, having its said thread means formed on its inner wall.

14. Connector means according to claim 13 wherein said slot means include at least six longitudinally extending slots formed in said thread means of said collar in a generally symmetrical arrangement.

15. Connector means according to claim 1 wherein said connector means comprise electrical connector means adapted to be coupled to the end of an insulated electrical cable, and which further includes:

a generally cylindrical connector body adapted to be electrically coupled to said cable, said connector body being receivable in said housing member;

at least two flexible and substantially resilient clip members affixed to substantially diametrically opposed sides on one of said connector body and said connector housing, said clip members being formed with fastening means adapted for lockable engagement with suitable receiving means; and, wherein the other of said connector body and said connector housing includes receiving means adapted to lockably engage said fastening means when said connector body is inserted into said housing member, such that said connector body can be lockably installed within said housing member to provide dead faces on said connector body free of any metallic fasteners.

16. Connector means according to claim 15 wherein each of said clip members comprises a generally elongate strip of resilient flexible material, having its free end rolled back over itself to form a generally rounded fastening bead and wherein said receiving means comprise a lip formed on said other of said connector body and said connector housing, said lip adapted to lockably receive said fastening bead by allowing said fastening bead to slide over said lip in a generally ratchet-like manner during insertion of said connector body into said connector housing member but substantially prevent removal of said connector body from said connector housing member.

17. Connector means according to claim 16 wherein said clip members are affixed substantially near the outer wall of said connector body and said lip is formed on the inner wall of said connector housing member.

18. Connector means according to claim 1 wherein said grasping means comprise a plurality of chuck members positioned between said housing and collar members when said body and cap members are threadably coupled, said chuck members being formed with a plurality of grasping teeth adapted to engage said cable for spreading any clamping forces acting on said cable over a large area to avoid cutting or crushing said cable, such that said chuck elements travel both transversally, generally parallel to the longitudinal axis of said housing member, and radially inwardly to grasp said cable and relieve any strain thereon due to its connection to a connector body.

19. Connector means according to claim 18 wherein said grasping means comprises three chuck members interconnected by and substantially symmetrically arranged by a connecting band and wherein each of said chuck members are formed with four grasping teeth.

20. Connector means according to claim 19 wherein said grasping means in molded in a unitary structure from a moldable plastic material.

21. Electrical connector means adapted to be coupled to the end of an insulated electrical cable, which comprises:

a generally cylindrical connector body adapted to be electrically coupled to said cable;

a generally cylindrical connector housing member, said housing member being generally hollow for receiving said connector body and said cable;

at least two flexible and substantially resilient clip members affixed to substantially diametrically opposed sides on one of said connector body and said connector housing, said clip members being formed with fastening means adapted for lockable engagement with suitable receiving means;

receiving means formed on the other of said connector body and said connector housing, said receiving means adapted to lockably engage said fastening means when said connector body is inserted into said housing member, such that said connector body can be lockably installed within said housing member to provide dead faces on said connector body completely free of any metallic fasteners.

22. Electrical connector means adapted to be coupled to the end of an insulated electrical cable, which comprises:

a generally cylindrical connector body adapted to be electrically coupled to said cable;

a generally cylindrical connector housing member, said housing member being generally hollow for receiving said connector body and said cable;

at least two flexible and substantially resilient clip members affixed to generally diametrically opposed sides on one of said connector body and said connector housing, each of said clip members comprising a generally elongate strip of resilient flexible material having its free end rolled back over itself to form a generally rounded fastening bead;

receiving means formed on the other of said connector body and said connector housing, said receiving means comprising a lip formed on said other member, said lip adapted to lockably receive said fastening bead by allowing said fastening bead to slide over said lip in a generally ratchet-like manner when said connector body is inserted into said housing member but substantially prevent removal of said connector body from said housing member when said bead and said lip are lockably engaged, such that said connector body can be lockably installed within said housing member to provide dead faces on said connector body completely free of any matallic fasteners.

23. Connector means according to claim 22 wherein said clip members are affixed substantially near the outer wall of said connector body and said lip is formed on the inner wall of said connector housing member.

24. Electrical connector means adapted to be coupled to the end of an insulated electrical cable, which comprises:

a generally cylindrical connector body adapted to be electrically coupled to said cable, said connector body comprising:

a coupling member having electrical coupling means attached thereto for coupling with corresponding coupling means of another connector, and a connector member adapted for attachment to said coupling member with electrical contact means mounted in said connecting member for electrically coupling said cable to said electrical coupling means formed on said coupling member, said coupling and connecting members defining at least two recesses therebetween;

a generally cylindrical connector housing member, said housing member being generally hollow for receiving said connector body and said cable;

at least two flexible and substantially resilient clip members affixed to substantially diametrically opposed sides of said connector body, each of said clip members comprising a generally elongate strip of resilient flexible material formed with fastening means at one end thereof adapted for lockable engagement with suitable receiving means formed on said connector housing, and having a leg portion extending generally perpendicular to said strip at the other end thereof, said leg portion being adapted to be lockably retained in one of said recesses;

receiving means formed on said connector housing, said receiving means adapted to lockably engage said fastening means when said connector body is inserted into said housing member, such that said connector body can be lockably installed within said housing member to provide dead faces on said connector body completely free of any metallic fasteners.

25. Connector means according to claim 24 wherein said fastening means on said clip members are formed by rolling said one end back over itself to provide a generally rounded fastening bead; and wherein said receiving means comprise a lip formed in said housing, said lip adapted to lockably receive said fastening bead by allowing said fastening bead to slide over said lip in a generally ratchet-like manner when said connector body is inserted into said connector housing member but substantially prevent removal of said connector body from said connector housing member when said bead and said lip are lockably engaged.

26. Connector means according to claim 25 wherein said electrical contact means are mounted to said connecting member such that said contact means are substantially contained within the area defined by the outer perimeter of said body, for unobstructed slidable insertion into said housing.

27. Connector means according to claim 26 wherein said connecting member further includes:

recesses extending radially inwardly of said connecting member and adapted to support said contact means, the number of said recesses being equal to the number of said contact means; and an equal number of apertures formed in said connecting member, said apertures spacially coupling said recesses with the interior of said housing, such that wires of said cable can be inserted through said apertures and into said recesses for coupling to said electrical contact means in said recesses.

28. Connector means according to claim 27 wherein said electrical contact means comprise:

a first contact plate fixedly mounted within said recess and coupled to said electrical coupling means on said coupling member, said first plate being formed with an unthreaded aperture;

a second contact plate formed with a threaded aperture therein;

threaded fastener having a bearing head, said threaded fastener means adapted to be slidable through the aperture in said first plate and to threadably engage said second plate, such that said plates may be firmly fastened together by threading said threaded fastener into said threaded aperture with said head bearing against said first plate.

29. Connector means according to claim 28 which further includes biasing means positioned in said recess for urging said second plate toward said first plate.

30. Connector means according to claim 29 wherein said biasing means comprises a resilient insulative foam.

31. Connecting means according to claim 24 which further includes a plurality of threaded fasteners and wherein said coupling member is formed with said plurality of projections extending towards said connecting member and having boreholes generally central thereof, adapted to receive one of said threaded fasteners; and wherein said connecting member is formed with said plurality of recesses adapted to receive said projections and with said plurality of boreholes, each adapted to align with said boreholes in said coupling member for permitting insertion of one of said threaded fasteners through said borehole in said connecting member and engagement of said fastener with the aligned borehole on said coupling member such that said coupling and connecting members can be secured together with no exteriorly exposed metallic fastener.

32. Connecting means according to claim 25 which further includes means formed on said housing for permitting release of said bead members from engagement from said lips to enable disassembly of said housing and body members when desired.

* * * * *